United States Patent [19]

Scarlett et al.

[11] 4,140,630

[45] Feb. 20, 1979

[54] SORTING APPARATUS FOR FRAGMENTED MATERIALS

[75] Inventors: Robert D. Scarlett, Balsam Lake; Roland E. Seager, Luck, both of Wis.

[73] Assignee: Durex Products, Inc., Luck, Wis.

[21] Appl. No.: 723,707

[22] Filed: Sep. 16, 1976

[51] Int. Cl.[2] ..... B07B 1/28

[52] U.S. Cl. ..... 209/313; 209/400; 209/403

[58] Field of Search ..... 209/400–403, 209/313, 405, 408, 393, 394, 395, 98, 99

[56] References Cited

U.S. PATENT DOCUMENTS

| | | | |
|---|---|---|---|
| 31,981 | 4/1861 | Hunter | 209/313 |
| 656,200 | 8/1900 | Martin | 209/393 |
| 810,682 | 1/1906 | Shafer | 209/400 |
| 1,739,701 | 12/1929 | Wilson | 209/400 |
| 2,052,467 | 8/1936 | Hermann | 209/401 |
| 2,139,089 | 12/1938 | Linke | 209/403 |
| 2,274,701 | 3/1942 | Jenks | 209/408 X |
| 2,315,055 | 3/1943 | Heller | 209/401 X |
| 2,378,463 | 6/1945 | Burls | 209/402 |
| 2,456,075 | 12/1949 | Newhouse | 209/403 X |
| 2,479,945 | 8/1949 | Lincoln | 209/403 X |
| 3,042,206 | 7/1962 | Olendes | 209/405 X |
| 3,870,630 | 3/1975 | Tylinski | 209/403 |

FOREIGN PATENT DOCUMENTS

| | | | |
|---|---|---|---|
| 286159 | 2/1915 | Fed. Rep. of Germany | 209/313 |
| 750316 | 1/1945 | Fed. Rep. of Germany | 209/403 |
| 1801248 | 5/1970 | Fed. Rep. of Germany | 209/405 |
| 701478 | 1/1931 | France | 209/313 |
| 1245468 | 9/1960 | France | 209/403 |
| 38081 | 12/1935 | Netherlands | 209/99 |

OTHER PUBLICATIONS

Faggart, Handbook of Mineral Dressing, 1947, pp. 7–12, 7–13.

*Primary Examiner*—Robert Halper

*Attorney, Agent, or Firm*—Williamson, Bains, Moore & Hansen

[57] ABSTRACT

An improved sorting apparatus for sorting sand, rock, gravel and other fragmented material utilizes a wire screen panel having a plurality of sorting zones with the apertures of each zone having a different cross-sectional area. A multiplicity of equally spaced, parallel, serpentinely crimped, longitudinal wires extend from receiving end to discharge end of the panel and are rigidly retained by attachment shrouds at the ends, permitting the longitudinal wires to be tensioned and sagging of the wires avoided by gradually tightening and straightening the longitudinal wires. Mounting means is provided to mount the panel in most commercially available vibrating screen boxes and includes a stationary angle iron mountable at one end of the screen box to retain an attachment shroud at an end of the panel and further includes a plurality of clamping devices adjacent the remaining end of the screen box and engaging an attachment shroud at the remaining end of the panel. Each clamping device has a tensioning device attached to the screen box to permit the longitudinal wires to be selectively straightened and tensioned. Improved bridging means is provided to bow the intermediate section of the wire screen panel, thereby permitting sufficient tensioning of the longitudinal wires and causing them to assume mutually parallel positions, minimizing possible metal fatigue of the wires and extending the wear life of the panel.

6 Claims, 9 Drawing Figures

SORTING APPARATUS FOR FRAGMENTED MATERIALS

BACKGROUND OF THE INVENTION

The invention relates to the field of wire cloth screen surfaces or panels useful for sorting of sand, gravel, limestone or other fragmented materials, and includes a new, high-production wire cloth screen panel and means for mounting the panel in commercially available vibratory screen boxes.

Harp screens have been known and used for a number of years to sift fragmented material and to control the size of the material passing through the screens. Such harp screens have, in the past, been extremely expensive, formed of a multiplicity of generally parallel, elongated wires without transverse spacers, and such wires have been individually mounted and tensioned in screen boxes. Typically, substantial amounts of time are required to individually mount the many elongated wires, and maintenance time required to keep such screens effective is extremely high. In order for the screen to function effectively the individual wires must be kept continually taut. Because the wires rapidly stretch and sag when used in a conventional vibrating screen box, the wires have had to be continually adjusted to maintain proper tension or the harp screen would rapidly wear out and require replacement. The high initial cost of installing such harp screens and the substantial subsequent maintenance cost and downtime have discouraged extensive use of the harp screens even though high-production levels can be achieved with their use. Accordingly, it is desirable to provide a new, improved wire cloth panel having high-production capacity but which is inexpensive and easily installed and tensioned as a unit.

One serious shortcoming of the known harp screens is that their multiplicity of parallel, spaced-apart, longitudinal wires have not been interconnected by any transverse spacers or wires, and, accordingly, unless the wires have precisely the right tension and spacing, unwanted oversized particles tend to wedge between the wires and either pass through the screen or widen the gap between wires, thereby passing larger material through the screen than that intended. This shortcoming is further compounded as the wires stretch or sag in normal usage, thus requiring maintenance downtime to correct this condition.

Maintaining the commercially available harp type screens has been extremely time consuming and expensive. Available screens have their longitudinal wires individually adjustable, and an operator must individually tighten threaded shafts or the like for each of the myriad of wires to assure that the wires have the desired tension. Proper tension is critical because when the wires begin to sag, the excessive vibration can cause flexing of the wire, resulting in metal fatigue and breakage in a matter of hours. In heavy usage, an operator must adjust and tighten harp screen wires on numerous occasions during a day's operation, and when each of several hundred wires may require adjustment and tensioning the amount of downtime and the maintenance expense can become very substantial.

Still another problem encountered with standard commercially available wire screen panels is that such panels have great difficulty in sifting and classifying material which is moist or wet. When the material is moist and contacts a screen having standard apertures, the apertures tend to clog or blind almost immediately, thus seriously limiting the productive capacity of the wire cloth panel. The same problem is encountered with materials which are hydrous or hydroscopic and tend to absorb moisture from the air. Typical of such materials is ag-lime used for soil treatment in farming, and which requires sorting so as to not exceed a predetermined size range specified by state and federal regulations. Such material is frequently used in agriculture and is much in demand.

For a number of years those skilled in the art sought solutions by which hydrous or moist materials could be processed with wire cloth screens without clogging the wire cloth apertures. Prior to the invention, one of the better known solutions has been to utilize special electric heating equipment to heat the wire cloth panel itself to dry the wire, preventing the material from clinging to the wire panel and creating a blinding or clogging effect over the wire cloth apertures. While this technique has produced limited success, the cost of electrical heating devices and their installation is in the thousands of dollars, and immense amounts of electrical energy are required to keep the systems operating. Naturally, it would be desirable to provide an improved wire cloth screen panel which successfully handles moist or hydrous materials without clogging and without the need for electrical high-output heaters or the expenditure of great amounts of heat energy.

Accordingly, it would be highly desirable to provide a new and improved wire cloth screen surface or panel capable of rapidly sorting large quantities of fragmented material even when moist or hydrous in nature, a screen which is easily installed and maintained, and one which requires no heaters or electrical heat energy to operate. The present invention accomplishes these goals.

SUMMARY OF THE INVENTION

The invention comprises a new, improved wire cloth screening surface or panel with a plurality of sorting zones and mounting means for operatively attaching the panel in most commercially available vibrating screen boxes so as to be easily and quickly installed to sort fragmented material such as rock, gravel, sand, ag-lime and other fragmented materials. In many instances the user can utilize existing vibrating screen equipment, eliminating the need to purchase new equipment at much higher cost.

The new, improved wire cloth screen panel includes a multiplicity of elongated, generally parallel, equally spaced wires extending longitudinally between a pair of attachment shrouds located at receiving and discharge ends of the panel. Transverse spacers are provided on the panel to retain the wires at predetermined equal distances between one another so as to define apertures in the screen panel and thereby control the size of the particles of rock, gravel or other material which can pass between the adjacent wires. The longitudinal wires are serpentinely crimped so that wire tension may be more easily maintained by gradual straightening of the wires as tension is applied to the wire cloth screen panel.

A plurality of sorting zones are provided on the panel, a first zone having its spacers more widely separated from one another than those in the second or third zone, permitting increased sorting capacity in the first zone where the panel is most heavily loaded with fragmented material. Two, three or more zones may be utilized depending on the screening requirements, with successively increasing or decreasing coarseness being utilized with successively situated zones. Use of the new, improved wire cloth screen panel substantially increases output without any significant reduction in the uniformity of the sorting or classification, and requires no heaters or heat energy to be applied to the panel even when hydrous materials are being sorted. The panel significantly increases product output even when the fragmented material is moist.

Attachment shrouds are fixed to the ends of the longitudinal wires of the panel at both receiving and discharge ends, and, accordingly, the integral panel is easily installed in a screen box, removed therefrom or tensioned without adjusting individual wires, thereby greatly reducing maintenance and downtime, while still making it easy to maintain required wire tension.

The mounting means comprises a stationary member at one end of the vibrating screen box and on which an attachment shroud is retained. A plurality of clamping devices are adjacent to each other and located at the remaining end of the screen box to engage the remaining attachment shroud at the opposite end of the panel. Each clamping device is provided with a tension device connected with the screen box, so that selective parts of the panel can be tensioned as needed with the tension device, which in its preferred form includes a pair of generally parallel, threaded shafts which pass through an end of the vibrating screen box and are retained and tightened by means of nuts threaded onto the shaft.

The mounting means further comprises a pair of rigid, lateral supports fixed to the sidewalls of the vibrating screen box and carrying a plurality of bridge bars having generally T-shaped cross section to reduce bar vibration and thereby increase screen life. The bars bow the wire cloth panel upward to permit proper tensioning of the panel's longitudinal wires.

The mounting means is structured to be easily installed in or removed from commercially available vibrating screen boxes without disturbing the standard mounting devices now used in such vibrating screen boxes. Accordingly, such a vibrating screen box fitted with the mounting means of the invention can be used easily with the invention and then restored to its original condition with only minimal operator time required, thereby permitting the vibrating screen box to be used as originally intended by its manufacturer, while having the option of being equally usable with the invention.

The invention is extremely useful in separating large amounts of sand from larger gravel and small rock contained in sand. As appreciated by those skilled in the art, sand is an excess commodity in most sorting operations and it is frequently necessary to separate it from the desired and needed gravel or rock as early as possible in the sorting process. By separating out the sand at a very early stage, it will not enter the crushers, washers, or the like through which the gravel may move. Such early separation thus significantly reduces the load which would otherwise be carried by the conveyors, the load and wear which would be applied to the crusher and the energy needed to transport the loads from place to place. Equipment longevity is also increased by early separation of the sand.

The new, improved wire cloth screen panel and the mounting means used with it are extremely durable, resistant to hard use, easy to manufacture, simple to mount and highly reliable, yet substantially less expensive than the systems now commercially available.

These and other advantages of the present invention will become apparent from the more detailed following description and the appended drawings, in which like reference numerals have been affixed to like parts of the apparatus in the several views.

DESCRIPTION OF THE PREFERRED EMBODIMENTS

Figure 1:
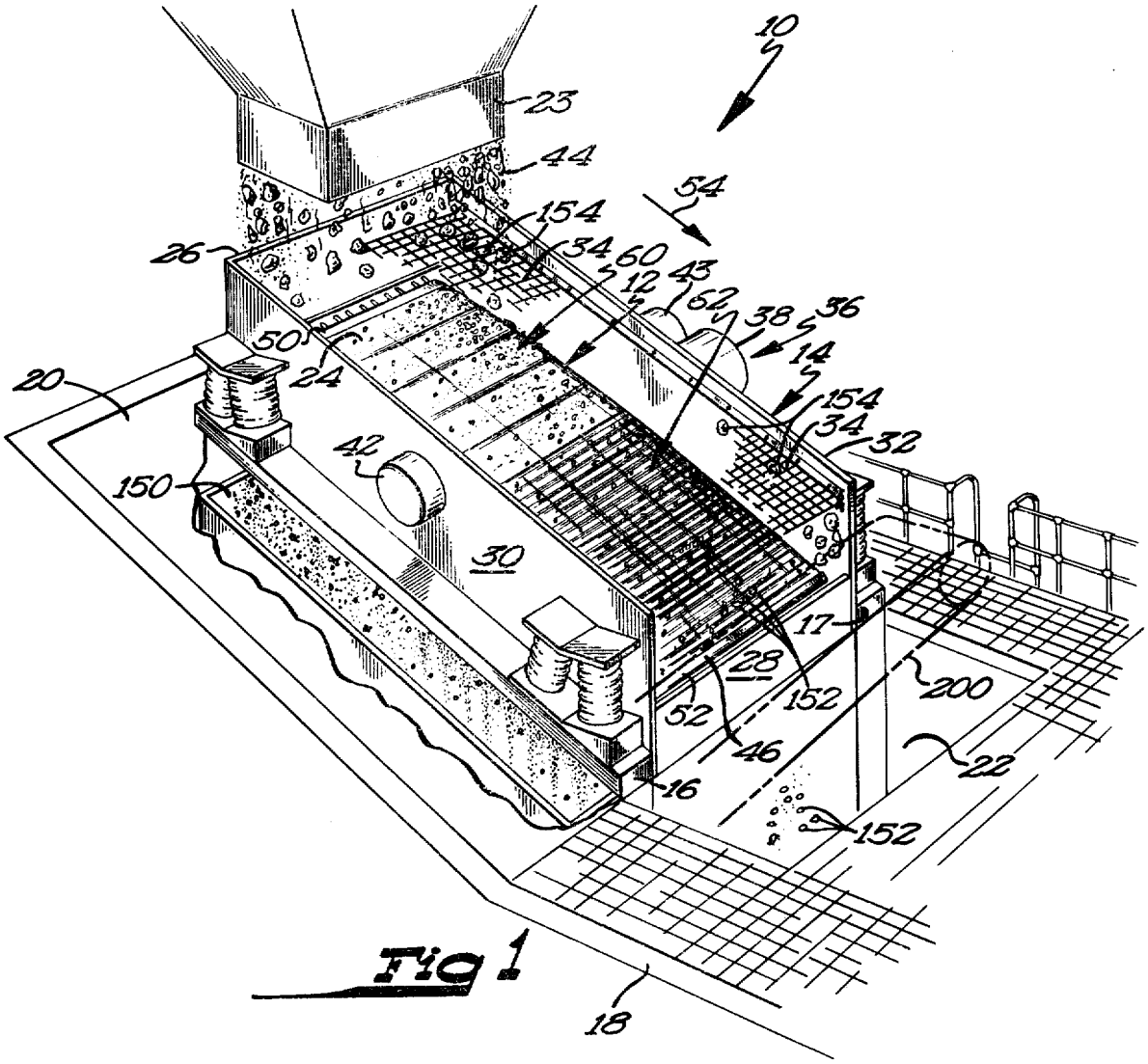
FIG. 1 is a perspective drawing of a vibrating screen box utilizing an embodiment of the invention and showing the invention in operation on a sorting tower or bin.

Referring now to FIG. 1, a sorting apparatus 10 embodying the invention is shown, the apparatus comprising an improved wire cloth screen panel 12 and mounting means attached to the screen box 14 to operatively attach the wire screen panel 12 therein.

The generally rectangular screen box 14 is shown supported on a pair of generally parallel, rigid I-beams 16 and 17 which are rigidly fixed in any known manner to the sides of a sorting tower 18. The tower 18 includes first and second upright receiving bins 20 and 22, the bin 20 being positioned to receive fragmented material dropping downwardly through the screen panel 12, and the bin 22 receiving material larger than that entering bin 20 and which being unable to pass through the screen panel 12 drops off its discharge end 46. In practice, the tower 18 may have the bins 20 and 22 provided with discharge chutes terminating over truck parking bays to permit easy loading of the sorted material 150 and 152. Naturally, the present invention is concerned only with the sorting of the fragmented material by size and not with the use of which the material is put or the handling of the material after sorting has occurred. An in-feed chute 23, feed box or conveyor is positioned above the receiving end 24 of the wire screen panel 12 and selectively discharges a supply 44 of fragmented material into the screen box 14 for sorting.

The screen box 14 utilized with the invention may be any of a wide variety of commercially available screen boxes. Typically, such a screen box is of generally rectangular configuration and formed of rigid metal plate material, the box having first and second rigid, spaced-apart lateral sidewalls 30 and 32, respectively, and first and second rigid endwalls 26 and 28 extending perpendicularly between and rigidly connected to the sidewalls. As will be appreciated by those skilled in the art, commercially available and known screen boxes have many configurations and constructions. The term endwall, as used herein, is intended to include any kind of panel, member, support, or connector extending between the sidewalls whether such panel, support or the like is oriented vertically, horizontally, or has any other angular relationship.

While the wire screen panel 12 may be used for sorting a wide range of fragmented material and can be made with a wide variety of specific dimensions or aperture sizes, it is particularly effective for sorting relatively small fragmented material. For example, the screen panel 12 may be designed to permit passage therethrough of particles having a predetermined size not exceeding one-half inch. When sorting small fragments it is desirable to avoid dropping larger rock or fragments onto the relatively fine mesh screen panel utilized for sorting of fine or small particles, and, accordingly, a wire cloth scalping screen 34 may be positioned above the wire cloth panel 12 and secured to the sidewalls or vibrating screen box 14 by clamping bars 106 and 107 (FIG. 2) or in any other known manner so as to intercept oversized fragments 154 which might otherwise damage the wire screen panel 12 or significantly reduce its longevity.

Typically, the vibrating screen box 14 is provided with a vibration device 36 for vibrating the wire screen panel 12 and scalper 34. The vibration device 36 generally includes an electric motor 38 drivingly connected in any known manner with a rotatable eccentrically weighted shaft 40 mounted in bearings 42 and 43. Accordingly, a supply 44 of fragmented material to be sorted is dropped from the overhead in-feed chute 23 onto the wire cloth scalping screen panel 34 where dangerously oversized fragments 154 are captured and removed, the smaller material passing through scalper panel 34 and thence downwardly onto the receiving end 24 of the wire cloth screen panel 12. The vibration device 36 assures continued movement of the material reaching the vibrating scalper 34 or panel 12 along the panels and in direction 54 toward the discharge end 46 of the screen panel 12, with the particles 152 too large to pass through screen panel 12 being dropped over the endwall 28 of the box 14 and into bin 22 while the particles 150, small enough to pass through screen panel 12, pass downwardly into bin 20.

Figure 2:
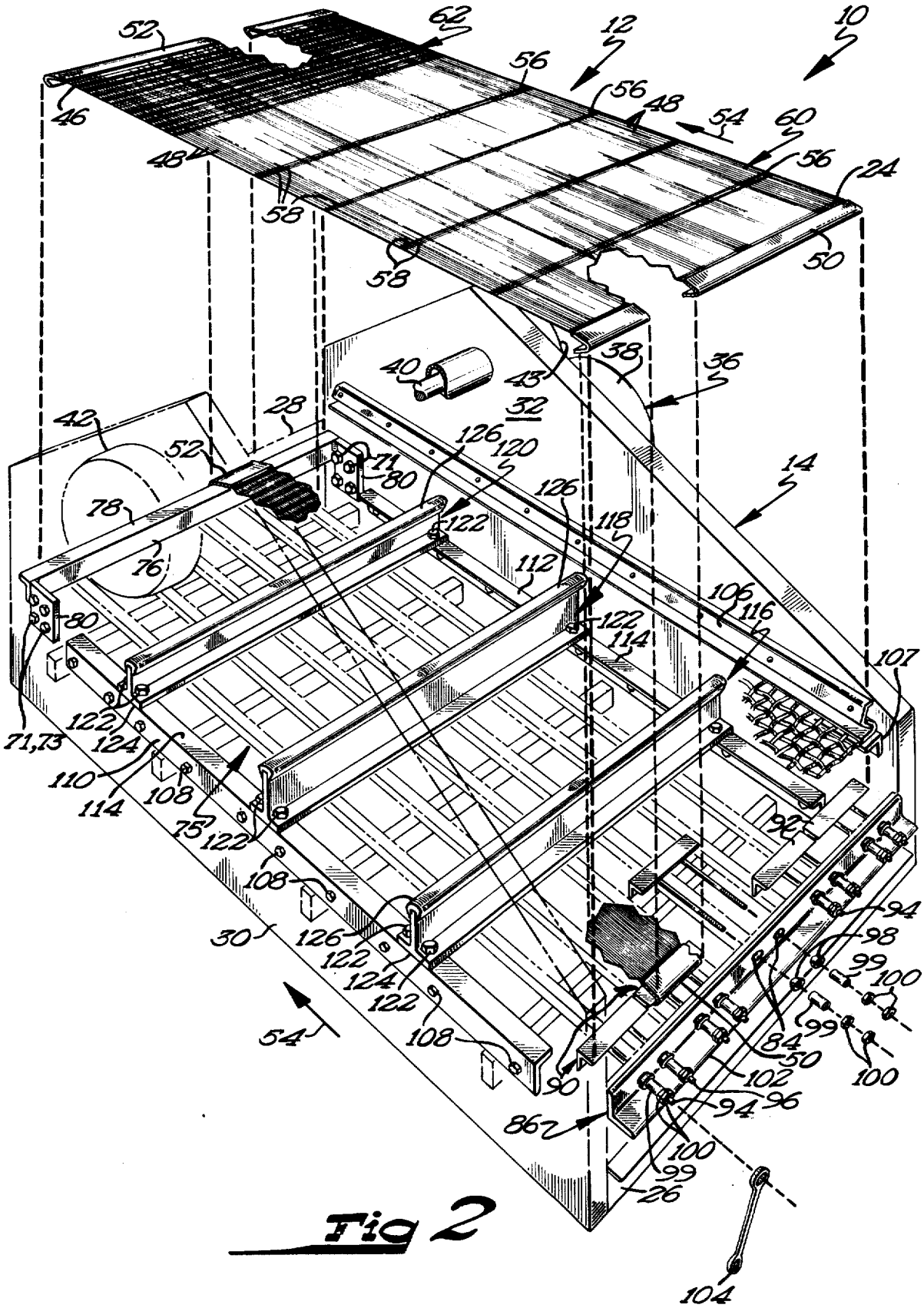
FIG. 2 is an exploded perspective drawing of the vibrating screen box of FIG. 1, the drawing being partly in phantom and with portions cut away to more clearly show the new, improved wire cloth screen panel of FIG. 1 and the mounting means used with it.
Figure 5:
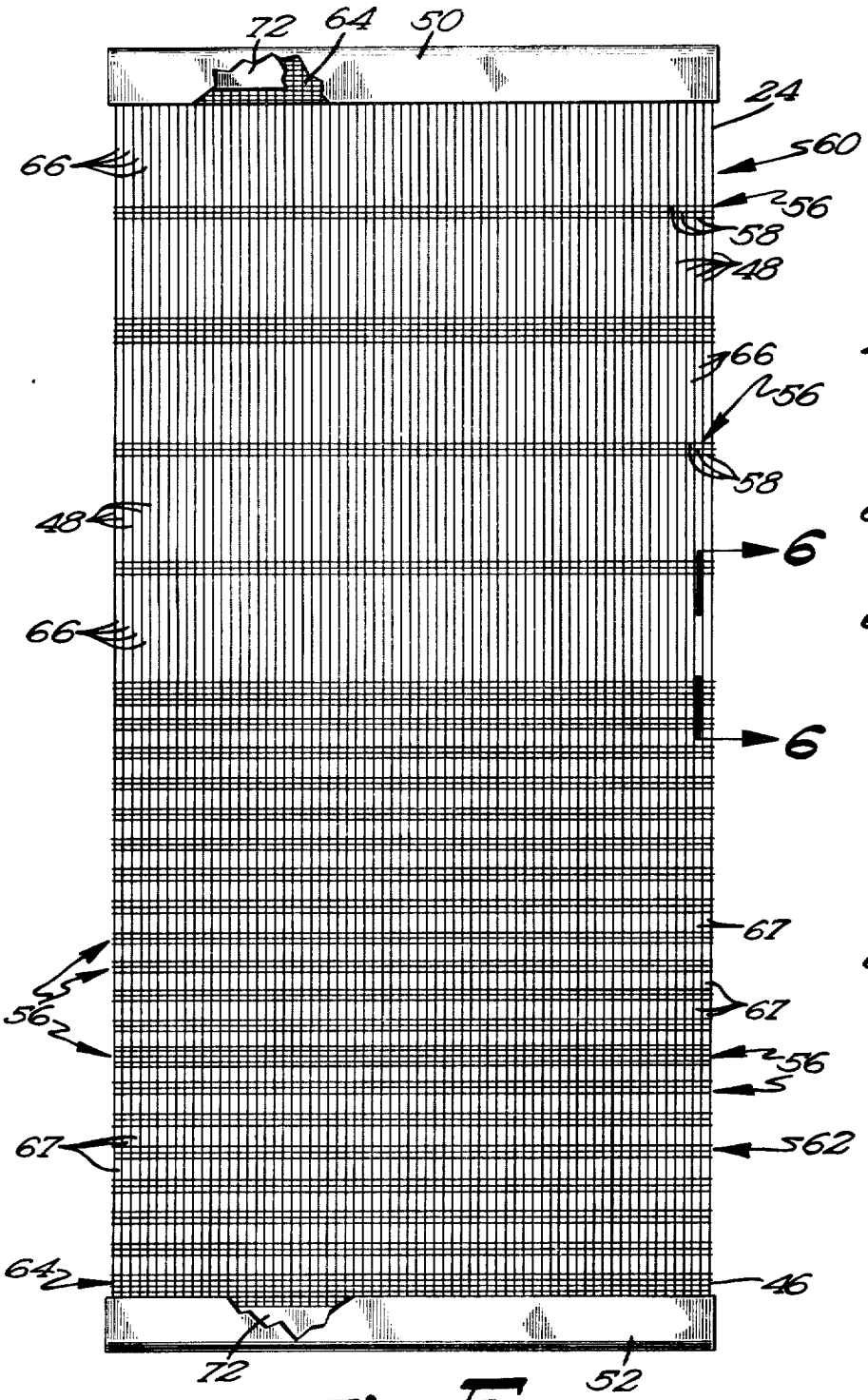
FIG. 5 is a top elevation view of an embodiment of the new, improved wire cloth screen panel.

Referring now to FIGS. 2 and 5, the wire screen panel 12 has a multiplicity of longitudinal, generally mutually parallel wires 48, all of which are substantially equally spaced from one another. The wires 48, which are abrasion resistant and substantially identical to one another, are preferably formed of a sturdy, long-lasting, high-carbon or stainless steel spring wire to resist the abrasion and wear associated with the sorting of fragmented material. The ends of each wire 48 are firmly retained in the attachment shrouds 50 and 52 located at ends 24 and 46 of the screen panel 12, in a manner to be further described hereafter, and each wire extends generally perpendicularly outwardly from the shrouds and is continuous and integral. The distance of separation between adjacent wires 48 is selected such that particles 150 of the fragmented material not exceeding a predetermined size can pass between wires 48 and fall downwardly through the screen panel, while other particles 152 having sizes larger than the predetermined size will be retained on the top of the screen panel 12 and moved along the screen panel in the flow direction 54 by vibration caused by device 36. The distance of separation between adjacent longitudinal wires 48 substantially determines the maximum sized particle which will pass through screen panel 12 and into bin 20. Although occasional oversized particles will from time to time work their way into bin 20, this is ordinarily acceptable so long as the numbers of such oversized material are kept within pre-assigned anticipated limits.

Figure 7:
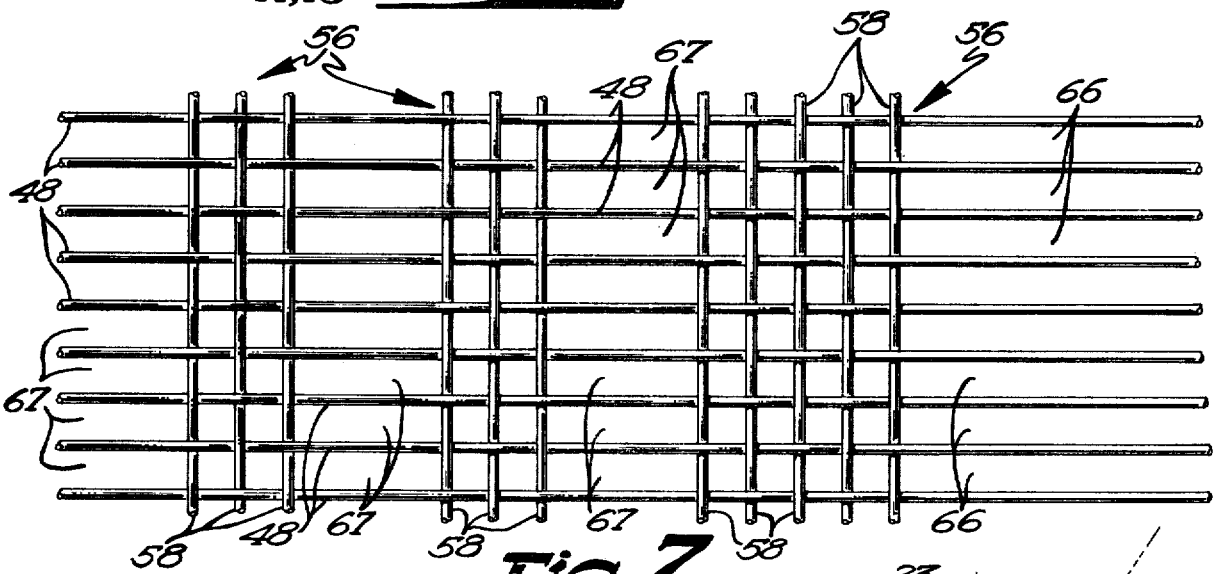
FIG. 7 is an enlarged top elevation view of the panel of FIG. 5 showing the serpentinely crimped construction.
Figure 6:
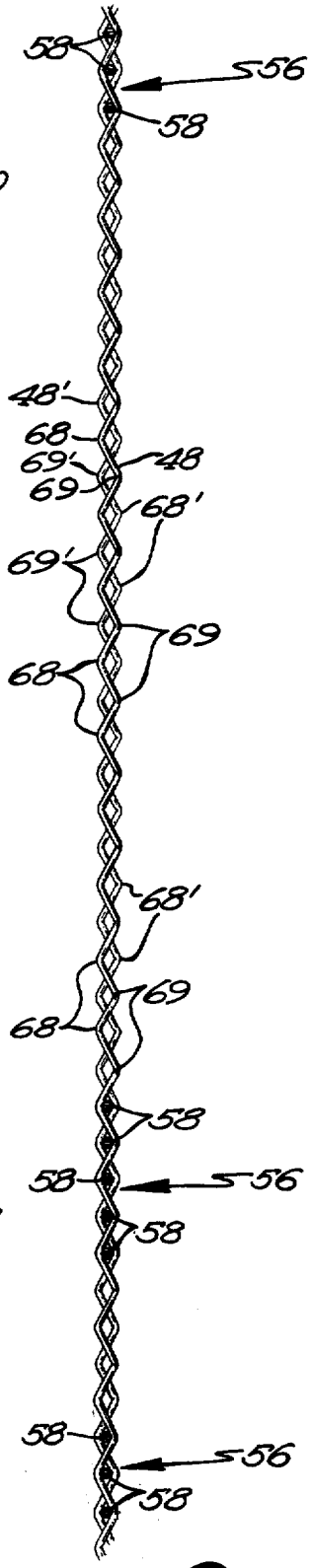
FIG. 6 is an enlarged cross-sectional side elevation view of the panel of FIG. 2 showing the construction thereof and taken in the direction of arrows 6—6 of FIG. 5.

A plurality of preferably parallel spacers 56 are spaced from one another and across the wire screen panel 12 transversely to wires 48, each spacer being comprised of a plurality of adjacent wires 58 which engage the longitudinal wires 48 in any known manner, but are preferably interwoven with the longitudinal wires 48, as best seen in FIGS. 6 and 7. These spacers 56 in cooperation with wires 48 define sorting apertures 66 and 67 throughout the wire cloth screen panel 12. It should be noted that certain of the spacers 56 are provided with five adjacent, generally parallel wires 58 while other spacers have a lesser number, such as three-wire clusters. It has been found desirable to have a larger number of wires comprising spacers which will contact bridge bars such as 116, 118, and 120 to make the cluster wider. This is desirable because as the panel is tensioned or straightened, the center-to-center distances separating the clusters will increase and the wider spacers will still remain in contact with the bridge bars. For this reason all the spacers in zone 60 have five-wire clusters. Another reason for the use of five-wire clusters in zone 60 but not in zone 62 is that the more closely positioned spacers 56 of zone 62 provide substantial lateral support for wires 48, while the zone 60 with its more widely spaced spacers 56 has less transverse support and a five-wire cluster provides extra lateral support. Preferably the spacers 56 are substantially mutually parallel to one another and substantially perpendicular to the wires 48.

Still wider bands 64 of transverse wires are located at receiving end 24 and discharge end 46 of screen panel 12 to provide a firm wire matrix about which the attachment shrouds 50 and 52 may be engaged.

Referring now to FIGS. 2 and 5, the wire screen panel 12 is provided with first and second sorting zones 60 and 62, respectively. The prior art has traditionally taught that to obtain consistent and uniform sorting properties in a screen, it is necessary that all of the apertures of the screen be substantially equal in size. The present invention, however, demonstrates that the use of an integral wire screen panel 12 having two or more sorting zones, each of which has sorting apertures of a different size, results in greatly increased output without any significant sacrifice in uniformity. To obtain such improved results, the spacers 56 are positioned at greater spaced-apart intervals in zone 60 than in zone 62. Accordingly, while the distance of separation between the longitudinal wires 48 is substantially uniform throughout the length of screen panel 12, the shown positioning of the spacers 56 define a plurality of sorting apertures 66 in zone 60 which are of larger cross-sectional area than the sorting apertures 67 in zone 62. With the shown screen panel construction, a much greater volume of fragmented material is sifted and sorted in zone 60 than in zone 62, which is, of course, desirable since zone 60 is almost always more heavily loaded than zone 62 because of its being adjacent the receiving end 24 of the screen panel immediately under chute 23.

Naturally, the specific dimensions of the elongated, generally quadrilateral apertures or slots 66 and the smaller cross-section apertures 67 can vary depending upon the required specifications of the material to be sorted. For example, when it is desired to sort material such as ag-lime for farming purposes, a screen panel having elongated slots or apertures 66 of approximately one-foot length and having apertures 67 of approximately one-inch length has been found to function very effectively, but it should be understood that the cross-sectional areas of these apertures can be varied to some extent and that the cross-sectional area of all the apertures in a given zone need not be precisely the same to obtain effective results. It has been found extremely helpful, however, that when two zones are provided, both zones have their longitudinal wires 48 spaced equally apart while the cross-sectional area of the apertures of one zone are substantially larger than the apertures of the remaining zone. It has also been found that excellent results are obtained with two-zone type screen panels when the large aperture zone 60 is approximately five feet long and the narrow-apertured zone 62 makes up the remainder of the screen panel. While two zones have been found highly desirable, it should be understood that the scope of the invention is not limited to the use of two zones and a number of zones exceeding two is within the scope of the invention.

Referring now to FIG. 6 which shows an enlarged cross-sectional side view of the wire screen panel 12 of FIGS. 2 and 5, each of the longitudinal wires 48 is provided with a multiplicity of substantially continuous, regularly arranged, and generally identical serpentine crimps 68 along its length between receiving and discharge ends of the screen panel and extending through all the zones of the screen panel. Adjacent wires 48 are positioned so that their serpentine crimps, if thought of as sinusoidal, are offset by 180° so as to weave into the longitudinal wires 48 the generally transverse wires 58 of spacers 56, the weaving technique associated with the making of such screen panels or wire cloth surfaces being well known to those skilled in the art and, accordingly, not discussed here. While the art has long appreciated the value of crimping to produce stronger, more durable woven wire cloth, it has not up to now utilized crimping as a means for tensioning the screen panel as taught by the present invention. By serpentinely crimping the individual longitudinal wires 48 along their entire length and including even those portions of their length which do not require crimping in order to position or receive transverse spacers, an extremely important advantage is derived. This advantage is that when the wire screen panel is clamped into operating position in the screen box 14, the screen panel 12 can be maintained in a fully tensioned condition by mechanically pulling the attachment shrouds 50 and 52 away from one another by tension forces applied to the shrouds, as will be described further hereafter, thereby slowly straightening the crimped wires 48 to thus assure an equal spacing and almost perfect degree of tension on the screen panel at all times.

As best shown in FIG. 6, the successive serpentine crimp notches 68 and 69 of wire 48 are offset approximately 180° from the laterally spaced and aligned crimp notches 68′ and 69′ of adjacent longitudinal wire 48′, and the crimped wires 48 and 48′ along with other longitudinal wires 48 cooperate to engage and weavingly retain the transverse wires 58 therebetween. If desired, the transverse wires 58 may also be serpentinely crimped to further improve the weave properties of the wire cloth surface or screen panel 12. As best shown in FIG. 7, the serpentine crimping 68 and 69 or 68′ and 69′ of each longitudinal wire 48 lies in and defines a generally upright plane, with all such planes being generally parallel to one another and perpendicular to the plane defined by the multiplicity of wires 48.

As best seen in FIG. 6, the surface of the screen panel 12 is somewhat rough and uneven because of the peaks and troughs created by the crimped longitudinal wires 48. This fairly rough-textured screen panel, when vibrated with a quantity of fragmented material thereon, has been found to be exceptionally effective in producing a large volume of sorted material well within acceptable commercial specifications. It is believed that the serpentine crimping of the longitudinal wires 48 contributes to the efficiency of the sorting and does improve the output performance in terms of increased sorting capacity and more uniform product.

Figure 3:
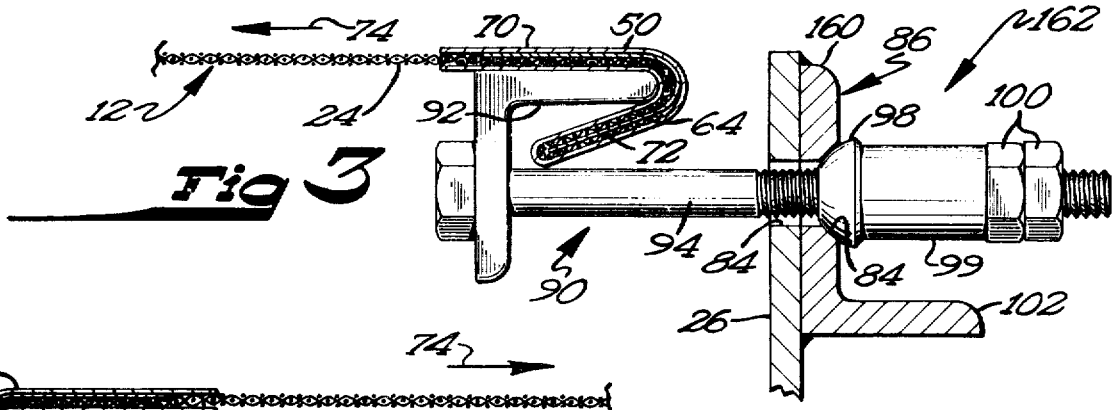
FIG. 3 is a cross-sectional, side elevation view of a portion of the mounting means used with the shown embodiment of the invention of FIG. 2.

Referring now to FIGS. 2 and 3, the attachment shroud 52, which is substantially identical to the shroud 50, is preferably formed of an integral metal sheet 70 of strong but bendable, malleable material and in which an end band 64 of the wire screen panel 12 has been inserted during bending and shaping of the sheet by a hydraulic press. The generally longitudinal wires 48 comprising the screen panel 12 have their ends thus contained within the shroud 50 and additionally are looped or bent about an inserted metal plate 72 which extends the full length of the shroud 50 or 52 from one lateral side of the screen panel 12 to the other. By looping the longitudinal wires 48 and the band 64 about insert plate 72 and then bending the sheet 70 and plate 72 to take on the arcuate, hook-like configuration of shrouds 50 and 52, an extremely durable and strong attachment shroud is formed. It should be noted that the insert plate 72 which is closely contained within the arcuate shroud 50 or 52 tends to lock and jam within the shroud as the wires 48 are pulled and tensioned in the direction 74, thereby further locking wires 48 and plate 72 within the shroud 52 and preventing their dislodgement.

Referring now to FIG. 2, the screen box 14, shown generally in phantom, is generally representative of commercially available vibratory screen boxes, and normally a wire screen panel is mounted within such a box by supporting it on the standard rectangular framework 75 provided with such boxes. Up to now a wire screen panel would generally have been mounted in the box by supporting it on the framework 75 and retaining the lateral edges of the panel to the lateral sidewalls 30 and 32 by clamps (not shown). It should be understood that improved mounting means of the invention, to be described hereafter, may be easily added to most commercially available screen boxes without removing the framework 75 or in any way adversely affecting the prior art panel mounting equipment. This results in the screen box being usable either with the present invention or with already known wire screen panels.

Figure 4:
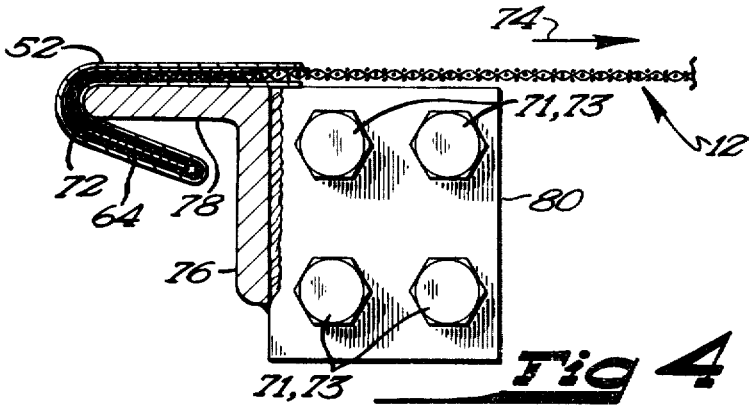
FIG. 4 is a cross-sectional, side elevation view showing the construction of the attachment shroud and another portion of the mounting means of FIG. 2.

Referring now to FIGS. 2, 3 and 4, a stationary member 76, preferably formed of rigid, durable, steel angle iron material, is carried by the box 14, extends transversely and preferably perpendicularly between the lateral sidewalls 30 and 32 and is spaced inwardly from endwall 28. The generally elongated, horizontal, planar web 78 of member 76 provides a shroud-engaging section 78 adapted to fit within and retain the arcuate, hook-like configuration of attachment shroud 52.

A pair of support brackets 80 is provided with a generally rectangular, rigid, preferably steel bracket being fixed to each end of the member 76 in any known manner such as by welding, each bracket 80 extending transversely, perpendicularly to the member 76. The stationary brackets 80 are positioned to confront and contact the inner surfaces of lateral sidewalls 30 and 32 of the screen box 14 and are provided with a plurality of bolt apertures, permitting the brackets to be rigidly, but removably, bolted to the sidewalls by bolts and nuts, 71 and 73, respectively.

Referring now to FIGS. 2 and 3, a rigid metal support strip 86 is fixed to the outer surface of the endwall 26 of screen box 14 by welding or any other means known to the art. The strip 86 is used to reinforce endwall 26, and a plurality of bores 84, arranged in pairs, pierce the strip 86 and the endwall 28, for a purpose to be described hereafter.

A plurality of clamping devices 90, all substantially identical to one another, are located adjacent endwall 26. In view of the identical nature of these clamping devices 90, only one of them will be described in detail.

Each clamping device 90 has an attachment shroud-retaining portion 92 which may be formed of an angle iron as shown or be shaped in some other manner so long as it will effectively engage and retain the attachment shroud 50 or 52. The retaining portion 92 is preferably formed of an elongate piece of heavy steel angle iron stock having a length of approximately one foot, although other lengths can be readily used. A pair of spaced-apart, preferably parallel threaded shafts 94 and 96 are rigidly fixed to the retaining portion 92 in any known manner such as bolting or welding and extend generally perpendicularly therefrom and toward endwall 26, passing perpendicularly through a pair of bores 84 in endwall 28 and strip 86. The generally parallel threaded shafts 94 and 96 of each clamping device 90 each have an alignment washer 98 slipped therealong and into contact with the strip 86. Immediately confronting each washer 98 is a spacer sleeve 99 which assures that the pair of threaded nuts 100 are spaced further from surface 160 than edge 102 to permit easy manipulation of the nuts with a wrench 104. A pair of threaded nuts 100 are threadably engaged on each of the shafts 94 and 96 to pull the shafts and the retaining portion 92 toward endwall 26 to thereby tension the screen panel 12 when it is in operating position. It has been found particularly helpful to utilize alignment washer 98 and spacer sleeve 99 so as to assure that the pair of nuts 100 extend beyond edge 102 of angle iron 86, thereby permitting an operator to easily apply a wrench 104 to either of the nuts 100 to tighten or loosen same while turning the wrench freely through 360° about the axes of any of the shafts 94 and 96.

Accordingly, the shafts 94 and 96, washer 98, sleeve 99 and nuts 100 collectively comprise one kind of tensioning device 162 connected between retaining portion 92 and screen box 14 to retain portion 92 to the screen box and for tensioning the wires 48 of the screen panel. Naturally, other types of tensioning devices could be used if desired or expedient, and all such modifications or types are within the purview of the invention.

Stationary member 76 and its attached brackets 80, the plurality of clamping devices 90, strip 86, lateral supports 110 and 112, bridge bars 116, 118 and 120, along with the associated mounting washers, sleeves and nuts, collectively comprise one type of mounting means for retaining the screen panel 12 in screen box 14.

The use of a plurality of clamping devices 90, each of which engages and retains the hook-like, arcuate, integral attachment shroud 50 permits the multiplicity of longitudinal wires 48 to be selectively adjusted with a substantial number of such wires being tightened or loosened by an operator merely tightening or loosening, respectively, a single pair of threaded shafts 94 and 96. Accordingly, if a particular portion of the screen panel is beginning to sag, the operator will tighten the nuts 100 on the shafts 94 and 96 of clamping device 90 which retains the ends of the sagging wires 48.

It should also be understood that shrouds 50 and 52 are formed of an appropriate gauge of metal which makes it feasible for a section or part of the shroud to be deformed more than the rest of the shroud so as to best utilize the selective tensioning capability of the plurality of clamping devices 90.

It has been found particularly desirable to position the clamping devices or rails 90 at the upstream or receiving end of the screen box 14 where they may be readily and easily accessible to an operator for adjustment. Because the new improved wire cloth screen panel in heavy usage requires regular tensioning, the positioning of the shafts 94 and 96 where they are readily accessible makes adjusting the screen panel easier and faster and reduces the amount of downtime required for maintenance.

Referring now to FIG. 2, a pair of substantially identical, rigid, metal lateral supports 110 and 112 are positioned against the inner surfaces of opposed sidewalls 30 and 32, respectively, and rigidly, releasably attached thereto by bolts and nuts, or other means known to the art. The supports 110 and 112, which are generally straight and parallel to one another and at the same vertical level in screen box 14, each carry an inwardly, cantileverly projecting, generally flat shelf 114 to which generally upright, stationary, T-shaped cross section bridge bars 116, 118 and 120 are releasably attached by bolts 122 or other means known to the art.

Each of the bridge bars is similar in construction with a T-shaped cross section, although the centermost bar 118 extends farther upwardly from shelf 114 than the other bars so as to bow the screen panel 12 upwardly, the three bridge bars comprising bridging means and cooperating in the bowing or bridging of the longitudinal wires 48 of screen panel 12 to further tension the panel.

Each of the bridge bars has its T-shaped base 124 supported securely on shelf 114 and T-shaped construction reduces and attenuates the vibration of the bridge bars in directions parallel to the wires 48 which would otherwise be generated by the vibration device 36, the T-shaped construction substantially damping such vibration and thereby increasing the life of panel 12. It is desirable to provide bridge bars which have minimal vibration where the bars contact panel 12 so as to minimize frictional wear on the panel at the points of contact. Use of a T-shaped cross section bridge bar substantially reduces such bar vibration. Other more lightweight bridge bars presently used by the art and not having a T-shaped cross section tend to vibrate substantially more at the points of contact with the panel and eventually weaken the panel. This problem has been substantially reduced by the T-shaped construction of the shown bridge bars 116, 118 and 120.

To further reduce wear of panel 12, the upper edge of each of the bridge bars has been provided with a cap 126 made of rubber or rubber-like material which firmly engages the wires of the panel and which is easily replaceable when it becomes worn.

Figure 8:
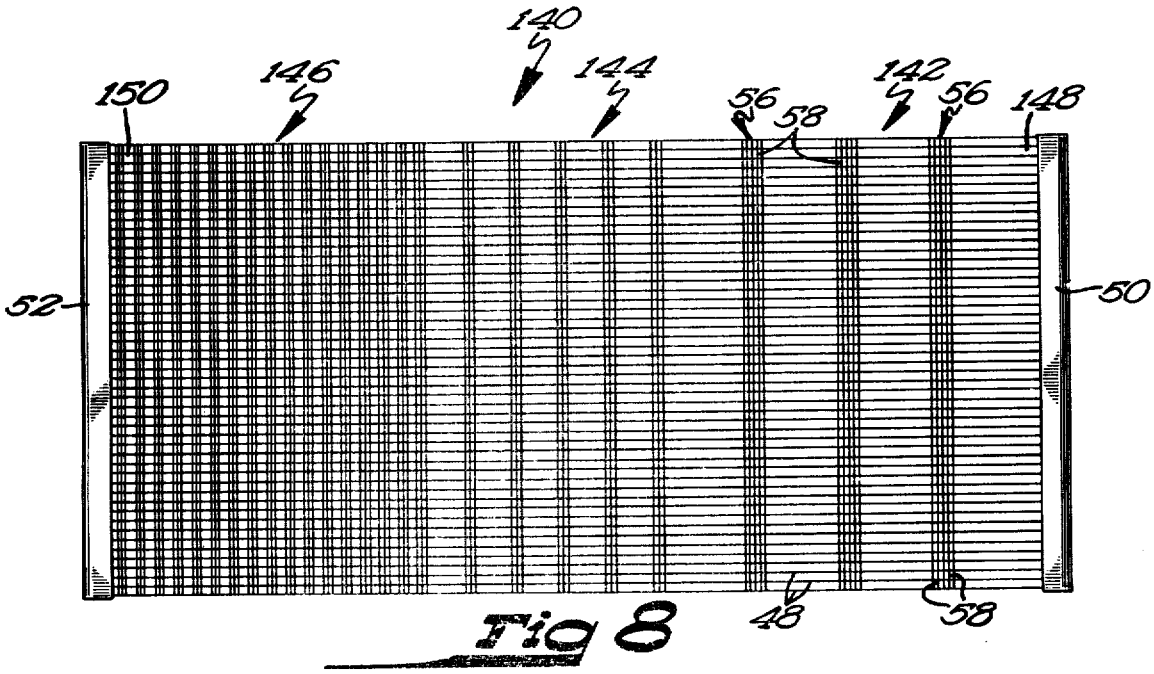
FIG. 8 is at top elevational view of a second embodiment of the invention and having three sorting zones.

Referring now to FIG. 8, an alternative embodiment 140 of a wire cloth screen panel is shown, the panel 140 being substantially identical in basic construction to the panel 12, with a multiplicity of longitudinal preferably serpentinely crimped wires 48 and transverse spacers 56. The panel 140 is provided with three distinct sorting zones, namely zones 142, 144 and 146. These zones are preferably arranged in order of descending coarseness with the greatest coarseness or largest apertures at the receiving end 148 of the panel and the finest apertures at the discharge end 150. For some sorting requirements a wire cloth panel having three, four or more zones is desirable and is within the scope of the present invention. Naturally, the vibrating screen box and its associated mounting means already described may be used with panels with three or more zones, the attachment means being substantially identical.

In operation, a commercially available vibratory screen box 14 such as that shown in FIG. 2 is first equipped with the already described mounting means before the wire cloth screen panel 12 is mounted in the box. Typically, an operator will first mount the stationary member 76 with its attached brackets 80 by drilling appropriate holes in the lateral sidewalls 30 and 32 of the box and bolting the brackets into the shown position by means of bolts and nuts 71 and 73.

An operator will then weld the rigid strip 86 to receiving end 24 of the screen box and thereafter drill pairs of spaced-apart bores 84 in appropriate positions, passing through strip 86 and through endwall 26 of the screen box. The plurality of clamping devices 90 may then be mounted at endwall 26 by passing the pair of parallel shafts 94 and 96 of each clamping device 90 through the bores 84. The alignment washer 98, spacer sleeve 99, and the pair of nuts 100 are then arranged on each of the threaded shafts to permit their selective tightening as described further hereafter.

The operator then attaches the lateral supports 110 and 112 to sidewalls 30 and 32, respectively, of the screen box by drilling appropriate holes and passing the bolts 108 therethrough and into the communicating already-threaded apertures in supports 110 and 112 or by any other means known to the art. Bridge bars 116, 118 and 120 are then bolted in place to the shelf 114 of each lateral support 110 or 112 to provide bridging means to bow the screen panel 12 upwardly.

The wire cloth sorting screen panel 12 may now be attached in the screen box with the discharge end 46 engaging stationary member 76, and the receiving end 24 engaging the plurality of clamping devices 90. The attachment shroud 52 of the screen panel is hooked around the outwardly extending, horizontal web 78 of angle iron 76. The remaining attachment shroud 50 is then looped or hooked about the retaining portions 92 of the plurality of clamping devices 90. The operator next proceeds to tighten the nuts 100 on each of the threaded shafts 94 and 96 until the wire cloth screen panel 12 has its multiplicity of longitudinal wires 48 at an acceptable level of tension where the wires are taut and parallel. There should be no appreciable sag in the wires 48 in order to avoid adjacent wires flapping and thereby becoming fatigued and breaking. As the panel is used, the wires 48 will tend to stretch and sag and periodically an operator must again tigthen the nuts 100 to properly tension the longitudinal wires 48. This tightening and maintenance step is easily accomplished because the nuts 100 are readily accessible at the receiving or feed end of the screen box, which is generally accessible and may be freely turned by an open-ended wrench 104 or other like tightening means.

Figure 9:
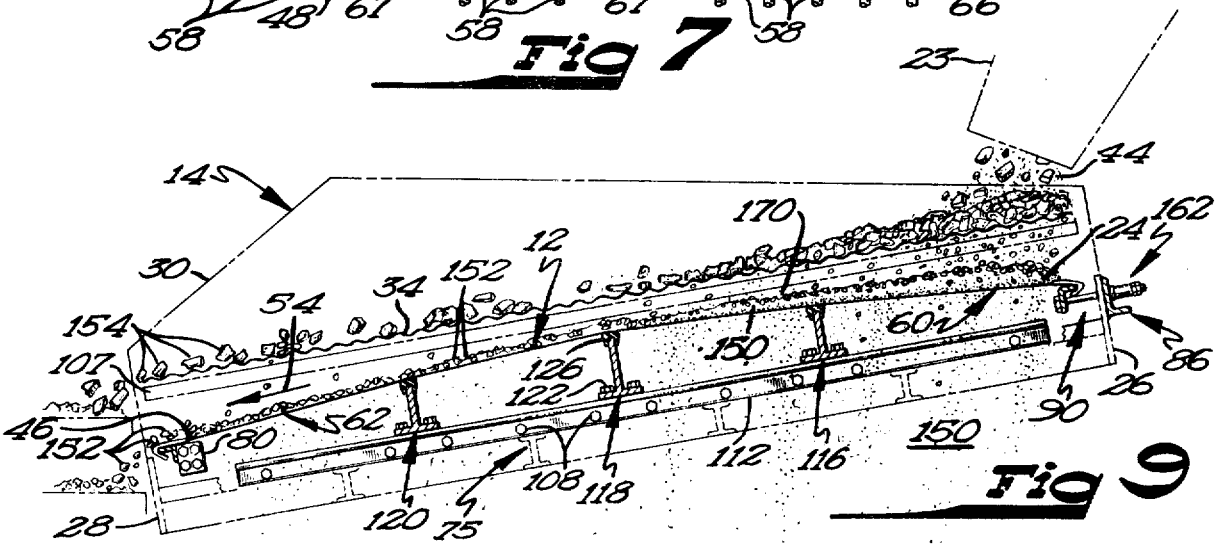
FIG. 9 is a side elevation view showing the operation of a vibrating sorting apparatus embodying the invention.

Referring now to FIGS. 1 and 9, in operation the scalping screen panel 34 may be positioned over the new wire cloth screen panel 12 in order to intercept and remove rocks and fragments 154 which are so large as to offer a threat of damage to the panel 12. Such rocks and fragments 154 are intercepted by the scalper 34 and the vibration of screen box 14 moves them along the scalper panel in direction 54 and deposits them on a conveyor belt 200 or drops them into an adjacent bin or chute.

The material 44 which it is desired to sort and some of which has passed through scalper panel 34 is received by the first zone 60 of the screen panel 12 and is preferably deposited on panel 12 in a layer 170 one to two inches in depth. It should be understood that the material dropped onto the panel 12 contains a wide variety of sized particles, all of which are small enough to pass through scalper 34 but some of which will not be small enough to go through screen panel 12 and still others which will successfully pass through the panel 12.

It has been found that with vibration of the screen box caused by vibration device 36, the finer particles 150 on zone 60 tend to work their way downwardly through the layer 170 of material and provide a kind of lower cushion or supporting layer for the larger particles 152 which tend to float on top of this cushioning layer of small particles 150 moving downwardly through the screen panel 12. These larger particles 152 gradually work their way along the screen panel in direction 54 toward the finer apertured second zone 62. Accordingly, a large percentage of the finer particles 150 which are capable of passing through the screen panel 12 work their way through the panel while in the zone 60, and the layer 170 of material gradually thins out as the material moves toward the second zone 62. The larger particles 152 often do not actually contact the screen panel 12 in zone 60, and instead are supported on top of the smaller, lighter particles 150 which gravitate downwardly toward the panel surface. By the time the smaller particles 150 have fully passed through the screen panel 12 in zone 60, the larger particles which would then no longer be supported on the cushion of finer particles 150 have reached the second zone 62 where the increased density of spacers 56 and transverse wires 58 prevent their easily wedging themselves between the longitudinal wires 48 and going through the screen panel 12.

Thus, the finer particles 150 capable of passing through the new wire cloth screen panel 12 drop into the lower storage bin 20 (FIG. 1) while the larger particles 152 exceeding a predetermined size stay on the screen panel 12 and are vibratorily moved along until they are dropped over the discharge end 46 of the panel at the endwall 28 and thence fall into bin 22 which is reserved for the particles 152 expected to be retained by the screen panel 12.

The heavy-duty T-shaped cross sections of the bridge bars 116, 118 and 120 make the bars less susceptible to vibration than would otherwise be the case and thus reduce wear between the screen panel 12 and the cap 126.

At any time that the operator desires to remove the new wire cloth screen panel 12 and use the standard state-of-the-art screen panel which was originally designed for the commercially produced screen box 14, he need only remove the stationary member 76 with its attached brackets, the plurality of clamping devices 90 and the pair of lateral supports 110 and 112 with the attached bridge bars, and the collective mounting means for the screen panel 12 can be removed and lifted from the screen box 14 and the original equipment screen panel reinstalled on framework 75.

While the preferred embodiments of the present invention have been described, it should be understood that various changes, adaptations and modifications may be made therein without departing from the spirit of the invention and the scope of the appended claims.

What is claimed is:

1. A sorting apparatus for sorting a supply of fragmented material so as to gather from the supply predetermined particles of the material which do not exceed a predetermined size and to separate from the supply other particles having a size exceeding such predetermined size, comprising:

a continuous, integral wire screen panel having a receiving end and a discharge end and including a multiplicity of longitudinal, generally mutually parallel continuous wires, each said wire being integral and extending continuously between said receiving end and said discharge end with the distance of separation between said continuous wires being substantially equal and the distance of separation being adapted to permit passage of the predetermined particles between said longitudinal continuous wires and through said screen panel and the retention of the other particles on said screen panel;

said screen panel further including a plurality of spacers spaced from one another and extending transversely to and engaging said multiplicity of continuous longitudinal wires to maintain the said distance of separation between said longitudinal continuous wires and cooperating with said longitudinal continuous wires to define sorting apertures through said screen panel; and said screen panel further including first and second sorting zones positioned along said screen panel and between said receiving and discharge ends with a plurality of said sorting apertures within said first zone being of larger cross sectional area than the sorting apertures within said second zone, permitting said first zone to sort a larger volume of fragmented material in a given time interval than said second zone and permitting said longitudinal continuous wires extending through said first and second zones to be easily tightened and maintained at a substantially uniform tension.

2. A sorting apparatus for sorting a supply of fragmented material so as to gather from the supply predetermined particles of the material which do not exceed a predetermined size and to separate from the supply other particles having a size exceeding such predetermined size, comprising:

a continuous, integral wire screen panel having a receiving end and a discharge end and including a multiplicity of longitudinal, generally mutually parallel continuous wires, each said wire being integral and extending continuously between said receiving end and said discharge end with the distance of separation between said continuous wires being substantially equal and the distance of separation being adapted to permit passage of the predetermined particles between said longitudinal continuous wires and through said screen panel and the retention of the other particles on said screen panel;

said screen panel further including a plurality of spacers spaced from one another and extending transversely to and engaging said multiplicity of continuous longitudinal wires to maintain the said distance of separation between said longitudinal continuous wires and cooperating with said longitudinal continuous wires to define sorting apertures through said screen panel;

said multiplicity of longitudinal continuous wires being serpentinely crimped so that tension forces applied to the said ends of said screen panel tend to straighten and tension said wires and thereby prevent unwanted sagging of said wires; and said screen panel further including first and second sorting zones positioned along said screen panel and between said receiving and discharge ends with a plurality of said sorting apertures within said first zone being of larger cross sectional area than the sorting apertures within said second zone, permitting said first zone to sort a larger volume of fragmented material in a given time interval than said second zone and permitting said longitudinal continuous wires extending through said first and second zones to be easily tightened and maintained at a substantially uniform tension.

3. The sorting apparatus of claim 2 wherein said first zone extends longitudinally along said screen for substantially five feet.

4. The sorting apparatus of claim 3 wherein said apertures of said first zone have a longitudinally extending length of substantially one foot and a distance of separation between adjacent continuous longitudinal wires of substantially one-half inch.

5. The sorting apparatus of claim 2 wherein said apertures of said first zone have a longitudinally extending length of substantially one foot and a distance of separation between adjacent continuous longitudinal wires of substantially one-half inch.

6. A sorting apparatus for sorting a supply of fragmented material so as to gather from the supply predetermined particles of the material which do not exceed a predetermined size and to separate from the supply other particles having a size exceeding such predetermined size, comprising:

a continuous, integral wire screen panel having a receiving end and a discharge end and including a multiplicity of longitudinal, generally mutually parallel continuous wires, each said wire being integral and extending continuously between said receiving end and said discharge end with the distance of separation between said continuous wires being substantially equal and the distance of separation being adapted to permit passage of the predetermined particles between said longitudinal continuous wires and through said screen panel and the retention of the other particles on said screen panel;

said screen panel further including a plurality of spacers spaced from one another and extending transversely to and engaging said multiplicity of continuous longitudinal wires to maintain the said distance of separation between said longitudinal continuous wires and cooperating with said longitudinal continuous wires to define sorting apertures through said screen panel;

said multiplicity of longitudinal continuous wires being serpentinely crimped so that tension forces applied to the said ends of said screen panel tend to straighten and tension said wires and thereby prevent unwanted sagging of said wires;

said screen panel further including first and second sorting zones positioned along said screen panel and between said receiving and discharge ends with a plurality of said sorting apertures within said first zone being of larger cross sectional area than the sorting apertures within said second zone, permitting said first zone to sort a larger volume of fragmented material in a given time interval than said second zone and permitting said longitudinal continuous wires extending through said first and second zones to be easily tightened and maintained at a substantially uniform tension;

a pair of attachment shrouds, one of said attachment shrouds being integral and fixed to said screen panel at said receiving end and extending continuously across the receiving end of said screen panel and retaining an end of each of said longitudinal, continuous wires and the remaining said shroud being integral and fixed to said screen panel at said discharge end and extending continuously across the discharge end of said screen panel and retaining the remaining end of each of said longitudinal, continuous wires, each said shroud having a hook-like cross section;

a generally rectangular, rigid screen box having first and second spaced apart lateral sidewalls and first and second endwalls extending between and connected to said sidewalls;

a rigid member attached to said box and retaining one of said integral shrouds of said screen panel;

a plurality of discrete clamping devices positioned transversely across said box and adjacent the remaining integral shroud of said screen panel with each said clamping device including an angle iron having a flat surface inserted within said hook-like cross section of said adjacent integral shroud to retain a portion of the shroud, each said clamping device further including a tensioning device connected between said angle iron and an endwall of said screen box for retaining said angle iron to said screen box and for tensioning said continuous longitudinal wires of said screen panel;

a rigid support strip fixed to the outermost side of said endwall to which said tensioning devices are connected and having a plurality of tapered bores passing through said strip;

a plurality of bores through said endwall communicating with said tapered bores of said strip;

each said tensioning device including:

a pair of substantially parallel threaded shafts fixed to each said angle iron;

a plurality of nuts threadably received on said shafts with at least one said nut on each said shaft confronting said strip;

a plurality of alignment washers;

an alignment washer being on each said threaded shaft and having a tapered face substantially complementary to each said tapered bore and matably inserted within said tapered bore of said strip; and a plurality of spacer sleeves, a said spacer sleeve being on each said shaft and positioned between said alignment washer and a said nut.

* * * * *